US007156956B2

(12) United States Patent
FitzPatrick

(10) Patent No.: US 7,156,956 B2
(45) Date of Patent: Jan. 2, 2007

(54) PAPER INDUSTRY PROCESS BELT WITH A SURFACE STRUCTURE COMPOSED OF A POROUS MEMBRANE

(75) Inventor: Keith FitzPatrick, Dieren (NL)

(73) Assignee: Albany International Corp., Albany, NY (US)

( * ) Notice: Subject to any disclaimer, the term of this patent is extended or adjusted under 35 U.S.C. 154(b) by 419 days.

(21) Appl. No.: 10/638,509

(22) Filed: Aug. 11, 2003

(65) Prior Publication Data

US 2005/0037681 A1 Feb. 17, 2005

(51) Int. Cl.
*D21F 7/08* (2006.01)
*B32B 5/22* (2006.01)

(52) U.S. Cl. ..... 162/358.4; 162/358.2; 162/900; 162/901; 442/76; 428/309.9

(58) Field of Classification Search ..... 162/204–207, 162/358.1, 358.2, 358.3, 358.4, 900–904, 162/348, 116, 117; 442/76, 77; 428/304.4, 428/306.6, 309.9
See application file for complete search history.

(56) References Cited

U.S. PATENT DOCUMENTS

| | | | | |
|---|---|---|---|---|
| 4,701,368 | A * | 10/1987 | Kiuchi et al. | 442/226 |
| 5,158,576 | A | 10/1992 | Brodmann | 8/938 |
| 5,238,537 | A | 8/1993 | Dutt | 162/358.4 |
| 5,298,924 | A | 3/1994 | Eklund et al. | 162/306 |
| 5,549,967 | A | 8/1996 | Gstrein | |
| 5,789,052 | A | 8/1998 | Miller et al. | 427/57 |
| 6,136,151 | A | 10/2000 | Davenport et al. | 162/306 |
| 6,331,231 | B1 | 12/2001 | Inoue | 162/358.4 |
| 6,428,874 | B1 | 8/2002 | McGahern et al. | 428/167 |
| 6,616,814 | B1 * | 9/2003 | Best | 162/358.4 |
| 2002/0060052 | A1 | 5/2002 | Best | 162/358.4 |
| 2003/0056925 | A1 | 3/2003 | Beck | 162/358.1 |

FOREIGN PATENT DOCUMENTS

| | | |
|---|---|---|
| EP | 1 085 125 A2 | 9/2000 |
| EP | 1 127 976 A | 8/2001 |
| WO | WO 99/18282 | 4/1999 |

* cited by examiner

*Primary Examiner*—Eric Hug
(74) *Attorney, Agent, or Firm*—Frommer Lawrence & Haug LLP;; Ronald R. Santucci

(57) ABSTRACT

A family of paper industry process belts ("PIPB's") having a range of properties for different applications in the paper industry. The PIPB can be a laminate comprising a grooved press belt and a porous membrane embedded therein and used as a substitute dewatering structure heretofore provided by press fabric(s).

11 Claims, 2 Drawing Sheets

PAPER INDUSTRY PROCESS BELT WITH A SURFACE STRUCTURE COMPOSED OF A POROUS MEMBRANE

FIELD OF THE INVENTION

The present invention is directed towards industrial process belts, particularly a family of paper industry process belts ("PIPB's") having a range of properties for different applications in the paper industry, and more particularly to a laminate comprising a vented press belt and a porous membrane used for dewatering a paper web in a press nip.

BACKGROUND OF THE INVENTION

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Rising energy costs have made it increasingly desirable to remove as much water as possible from the web prior to its entry into the dryer section. As the dryer drums are typically heated from within by steam, costs associated with steam production may be substantial, especially when a large amount of water must be removed from the web.

Traditionally, press sections have included a series of nips formed by pairs of adjacent cylindrical press rolls. However, the use of long press nips of the shoe type has been found to be more advantageous than the use of nips formed by pairs of adjacent press rolls. This is because the longer the time a web can be subjected to pressure in the nip, the more water can be removed there, and, consequently, the less water will remain behind in the web for removal through evaporation in the dryer section.

In long nip presses of the shoe type, the nip is formed between a cylindrical press roll and an arcuate pressure shoe.

The latter has a cylindrically concave surface having a radius of curvature close to that of the cylindrical press roll. When the roll and shoe are brought into close physical proximity to one another, a nip, which can be five to ten times longer in the machine direction than one formed between two press rolls, is formed. Since the long nip may be five to ten times longer than that in a conventional two-roll press, the so-called dwell time, during which the fibrous web is under pressure in the long nip, may be correspondingly longer than it would be in a two-roll press. The result is a dramatic increase in the dewatering of the fibrous web in the long nip relative to that obtained using conventional nips on paper machines.

A long nip press of the shoe type requires a special belt, such as that shown in U.S. Pat. No. 5,238,537 to Dutt (Albany International Corp.), the teachings of which are incorporated herein by reference. The belt is designed to protect the press fabric, which supports, carries and dewaters the fibrous web, from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness on at least the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web.

The base fabric of the belt shown in U.S. Pat. No. 5,238,537 may be woven from monofilament yarns in a single or multi-layer weave, and is woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and fibrous web. The base fabric may be flat-woven, and subsequently seamed into endless form, or woven endless in tubular form.

When the impregnating material is cured to a solid condition, it is primarily bound to the base fabric by a mechanical interlock, wherein the cured impregnating material surrounds the yarns of the base fabric. In addition, there may be some chemical bonding or adhesion between the cured impregnating material and the material of the yarns of the base fabric.

Long nip press belts, such as that shown in U.S. Pat. No. 5,238,537, depending on the size requirements of the long nip presses on which they are installed, have lengths from roughly 10 to 35 feet (approximately 3 to 11 meters), measured longitudinally around their endless-loop forms, and widths from roughly 6 to 35 feet (approximately 2 to 11 meters), measured transversely across those forms. The manufacture of such belts is complicated by the requirement that the base fabric be endless prior to its impregnation with a synthetic polymeric resin.

It is often desirable to provide the belt with a resin coating of some predetermined thickness on its outer surface as well as on its inner surface. By coating both sides of the belt, its woven base fabric will be closer to, if not coincident with, the neutral axis of bending of the belt. In such a circumstance, internal stresses which arise when the belt is flexed on passing around a roll or the like on the paper machine will be less likely to cause the coating to delaminate from either side of the belt.

Moreover, when the outer surface of the belt has a resin coating of some predetermined thickness, it permits grooves, blind-drilled holes or other cavities to be formed on that surface without exposing any part of the woven base fabric. These features provide for the temporary storage of water pressed from the web in the press nip, and are usually produced by grooving or drilling in a separate manufacturing step following the curing of the resin coating.

While some or all of the foregoing references have certain attendant advantages, further improvements and/or alternative forms, are always desirable.

SUMMARY OF THE INVENTION

It is therefore a principal object of the invention to provide a family of PIPB's having a range of properties for different applications in the paper industry.

It is a further object of the invention to provide a PIPB used to enhance nip dewatering or to substitute as the dewatering structure heretofore provided by press fabrics in a press nip.

A further object of the invention is to provide for a PIPB exhibiting minimal groove closure whilst promoting uniform pressure distribution in the press nip.

These and other objects and advantages are provided by the present invention. In this regard, the present invention is directed towards a family of PIPB's having a flexible range of properties. One example is a laminate comprising a grooved PIPB and a porous membrane on the surface of the grooved belt with a portion of the membrane embedded in such surface. Additionally, the membrane includes a substrate portion engineered into the grooved belt and a surface portion that faces the paper sheet. The membrane portion of the belt has several functions. It enhances the belt performance by providing additional void volume the total nip dewatering capacity of the press fabric(s) and grooved belt system. In some cases, such a composite belt could replace a press fabric(s) that would typically provide dewatering of a paper sheet in a press nip. Furthermore, the attachment of the membrane on the grooved belt surface can help to prevent groove closure under load, a problem that can appear as a belt ages. Such a composite structure then can employ a softer groove side resin system, which will alleviate the onset of land area cracking. Moreover, variations of the exact structure of the membrane substrate and surface are numerous, all of which allows for a variation of the resulting properties of the PIPB to meet the desired need.

BRIEF DESCRIPTION OF THE DRAWINGS

Thus by the present invention, its objects and advantages will be realized the description of which should be taken in conjunction with the drawings wherein.

DETAILED DESCRIPTION OF THE PREFERRED EMBODIMENT

Figure 1:
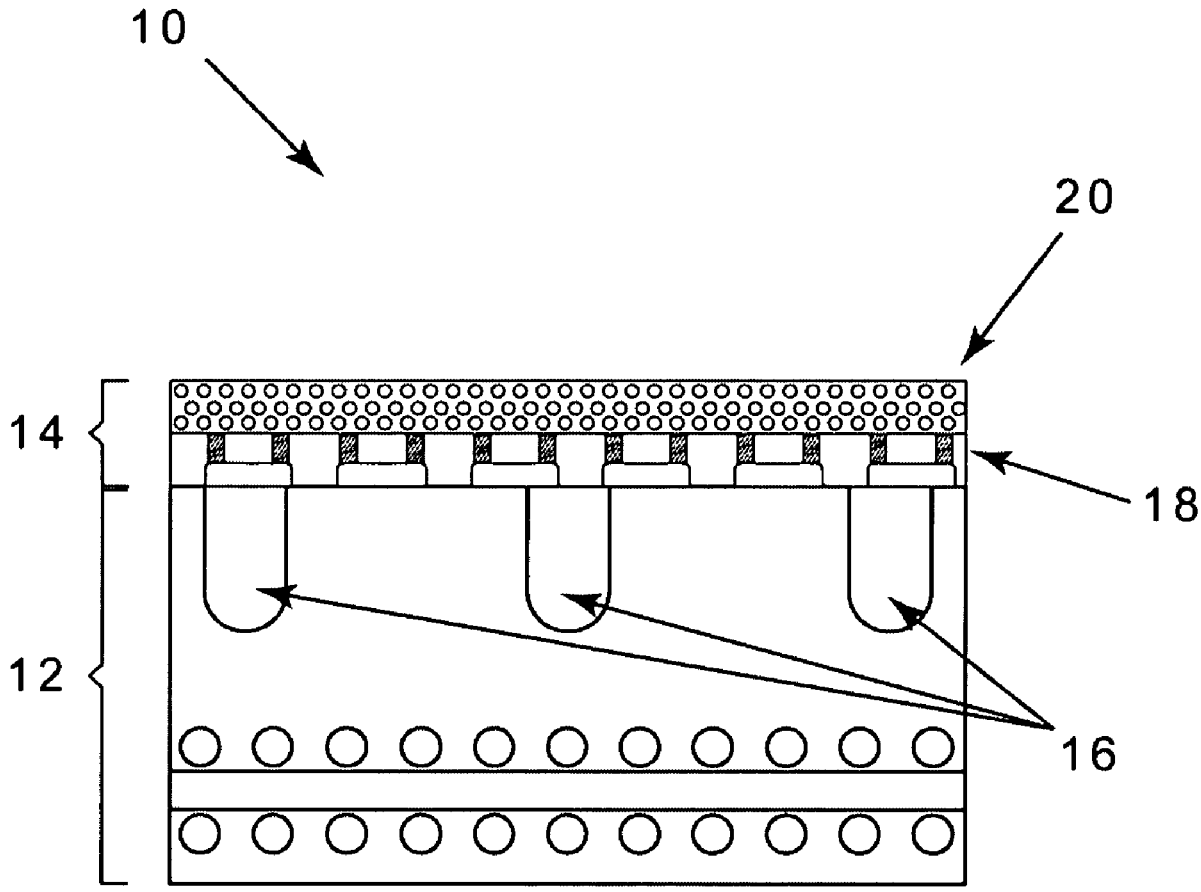
FIG. 1 is a side sectional view of an example of a PIPB, according to the present invention.

Turning now more particularly to the drawings, FIG. 1 illustrates (cross sectional view) one of many possible examples of the paper industry process belt 10 according to the present invention. Advantageously, the invention provides a family of PIPB's with a flexible range of properties for many different applications in the paper industry. In the example shown in FIG. 1, the inventive PIPB 10 is a laminate comprising a grooved PIPB 12 and a porous membrane 14 on the surface thereof. In the present example, the porous membrane 14 comprises a membrane substrate 18 covered by a membrane surface 20. Note that the membrane substrate 18 is embedded into the surface of the grooved PIPB 12. The membrane surface 20, on the other hand, is provided to interface with, for example, a paper or board sheet.

Referring further to FIG. 1, the membrane substrate 18 can comprise, for example, either woven yarns, a nonwoven matrix, or a combination thereof. In this connection, the yarns of the substrate 18 can be monofilaments, multifilaments, spun yarns, or other yarns suitable for the purpose. Further, these yarns can be pre-treated to enhance their adhesion to both the grooved PIPB 12 and to the membrane surface 20. The membrane surface 20, on the other hand, can comprise a porous polymer coating, a permeable polymer film, an assembly of short fibers or multifilaments, or other materials suitable for the purpose. In this way, the present invention provides for different combinations of substrate 18 and surface 20 so to obtain a variety of PIPB's 10 having a range of different properties for various applications. The porous polymer coating can be produced by a number of techniques known to those in the art such as laser drilling, removal of a soluble component with a suitable solvent, mechanically punching, or applying a resin as a reticulated or nonreticulated foam, for example.

Figure 3:
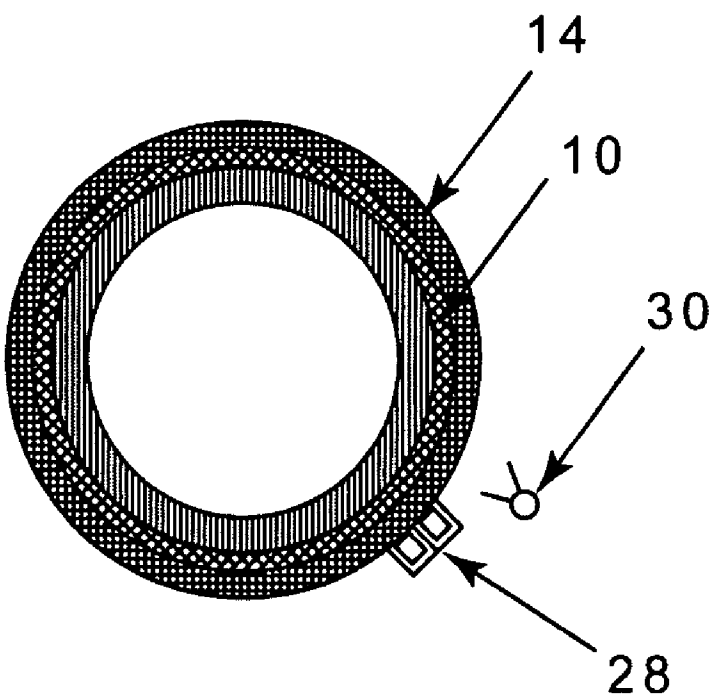
FIG. 3 illustrates a shower and suction box used to remove water from the PIPB.
Figure 2:
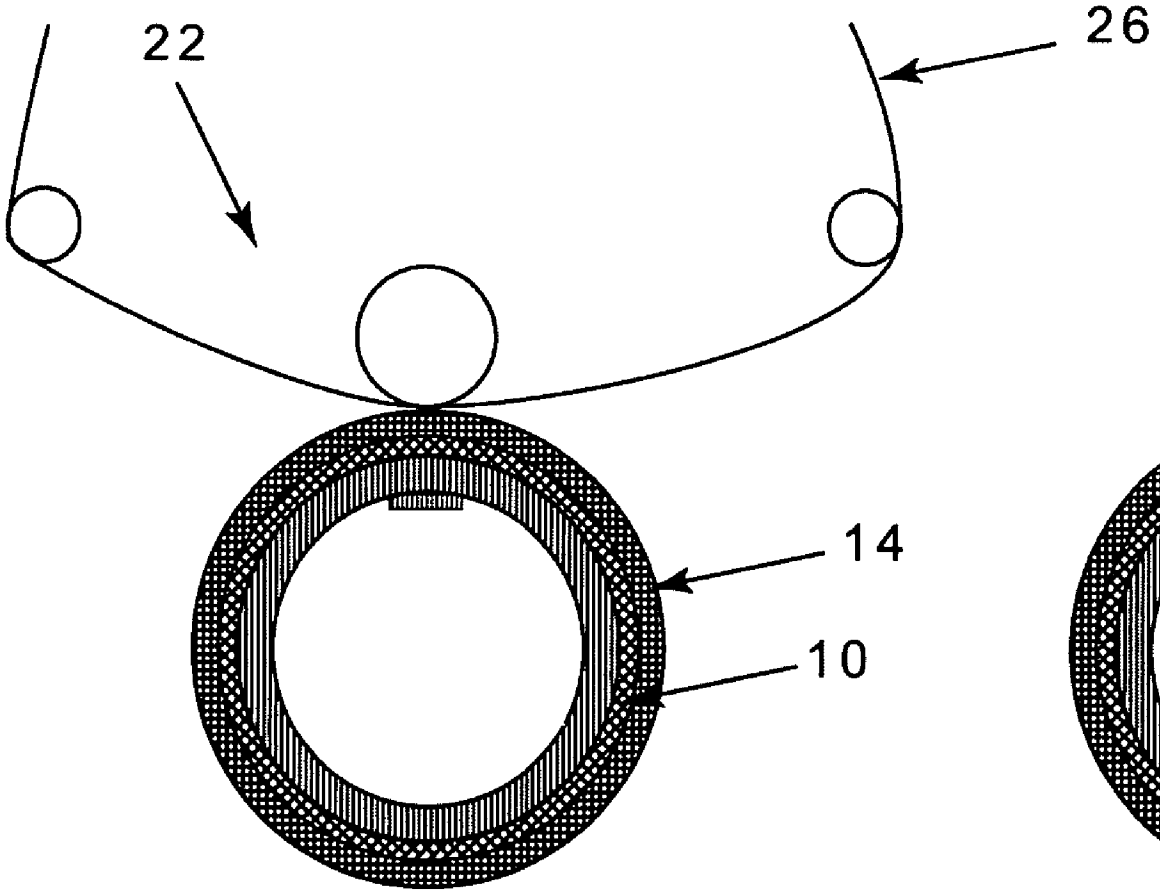
FIG. 2 is a side view depicting the inventive PIPB used for dewatering a paper sheet in a fabric-less press nip.

FIG. 2 illustrates an example of the inventive PIPB 10 used in the press nip 22 of a paper machine. In this connection, it should be understood that the complete "package" in a conventional press nip includes one or more press fabrics, a PIPB, the paper or board sheet, and opposing press rolls or other compressive elements such as a shoe. The present invention, on the other hand, may provide for a "fabric-less" press nip 22 in which the PIPB 10 with porous membrane 14 replaces the press fabric(s). That is, the PIPB 10 may provide the dewatering structure heretofore provided by a press fabric(s) in the press nip 22. Thus, as a paper sheet (not shown) is transported through the press nip 22 on the belt 26, water is pressed from the sheet directly into the PIPB 10. The water may be subsequently removed from the PIPB 10 via the suction box 28 shown in FIG. 3 if necessary.

Additionally, the PIPB 10 of the preferred embodiment of the present invention provides the advantage in that the porous membrane 14 locks the position of the belt grooves 16 (or other voids or cavities for recessing entrained water such as blind drill holes) so to restrict void or cavity closure in the press nip 22. It should be noted also that belt 26 may not include voids or cavities and would function as the transfer belt 26 shown in FIG. 2.

Thus by the present invention its objects and advantages are realized, and although preferred embodiments have been disclosed and described in detail herein, its scope and objects should not be limited thereby; rather its scope should be determined by that of the appended claims.

What is claimed is:

1. A paper industry process belt comprising a porous membrane outer surface, the porous membrane further comprising a membrane substrate embedded into a surface of said belt and a membrane surface for contacting a paper web with said belt being in a form of a laminate, wherein said belt includes grooves, blind drill holes, or other voids or cavities formed on said belt surface below the porous membrane.

2. The belt according to claim 1, wherein the membrane substrate comprises a woven structure.

3. The belt according to claim 1, wherein the membrane substrate comprises a nonwoven structure.

4. The belt according to claim 1, wherein the membrane substrate comprises monofilaments, multi-filaments, or spun yams.

5. The belt according to claim 1, wherein the yams of the membrane substrate are treated to enhance their adhesion to the belt surface and to the membrane surface.

6. The belt according to claim 1, wherein the membrane surface is a porous polymer coating, a permeable polymer film, an assembly of short fibers, or an assembly of multifilaments.

7. The belt according to claim 6, wherein the porous polymer coating is produced by laser drilling, removal of a soluble component with a solvent, mechanically punching, or applying a reticulated or nonreticulated foam.

8. The belt according to claim 1, wherein the belt having a porous membrane enhances dewatering in a press nip.

9. The belt according to claim 1, wherein water pressed from a paper web into the membrane portion of the belt is removed by suction.

10. The belt according to claim 1, wherein the porous membrane locks the position of the grooves so to restrict closure thereof.

11. A paper industry process belt comprising a laminate structure having a permeable membrane on a surface of a shoe press belt, wherein said shoe press belt includes grooves, blind drill holes, or other voids or cavities formed on said shoe press belt surface below the permeable membrane.

* * * * *